United States Patent [19]

Eckenrode et al.

[11] Patent Number: 4,586,556

[45] Date of Patent: May 6, 1986

[54] GUIDE RING FOR BOTTOM POUR INGOT MOULD SYSTEM

[75] Inventors: Paul D. Eckenrode, Newton Falls; Richard P. Eisenbrei, Youngstown, both of Ohio

[73] Assignee: Microdot Inc., Darien, Conn.

[21] Appl. No.: 629,816

[22] Filed: Jul. 11, 1984

[51] Int. Cl.[4] ..... B22D 33/00

[52] U.S. Cl. ..... 164/342; 164/DIG. 6; 249/109

[58] Field of Search ..... 164/137, 322, 323, 339, 164/346, 342, DIG. 6, 327; 249/109, 120, 110, 118; 425/182, 190; 141/369, 370, 113

[56] References Cited

U.S. PATENT DOCUMENTS

| | | | |
|---|---|---|---|
| 235,796 | 12/1880 | Morse | 249/109 |
| 602,714 | 4/1898 | Barker | 164/327 |
| 2,472,071 | 7/1945 | Gathmann | 164/342 |
| 4,287,155 | 9/1981 | Tersteeg et al. | 141/130 |

FOREIGN PATENT DOCUMENTS

| | | | |
|---|---|---|---|
| 53-42250 | 4/1978 | Japan | 164/339 |
| 849362 | 9/1960 | United Kingdom | 249/109 |
| 900960 | 1/1982 | U.S.S.R. | 164/DIG. 6 |

*Primary Examiner*—Nicholas P. Godici
*Assistant Examiner*—G. M. Reid
*Attorney, Agent, or Firm*—Lyman R. Lyon

[57] ABSTRACT

A quick change guide ring for a bottom pour ingot mould system to effect positioning of a plurality of moulds relative to outlets in a sprue plate.

1 Claim, 3 Drawing Figures

GUIDE RING FOR BOTTOM POUR INGOT MOULD SYSTEM

BACKGROUND OF THE INVENTION

1. Field of the Invention

The invention relates to improved apparatus for positioning steel ingot moulds on a sprue plate.

2. Description of the Prior Art

Ingots used as raw material in the steel rolling and steel forging processes are generally made by pouring molten steel into cast-iron ingot moulds. The molten steel is either poured directly into the ingot mould from the top or, preferably, is introduced to the mould through a sprue extending through an aperture in the bottom of the mould. Thus, positioning of the mould relative to the sprue is critical.

SUMMARY OF THE INVENTION

The invention relates to a novel guide ring that is releasably mounted on the the sprue plate of a bottom pour ingot mould system. The sprue plate has upstanding guide pins that are accepted in complementary recesses in the guide ring. The guide ring has an outer peripheral configuration that engages and positions an alignment flange on the ingot mould.

DETAILED DESCRIPTION OF THE PREFERRED EMBODIMENT OF THE INVENTION

Figure 1:
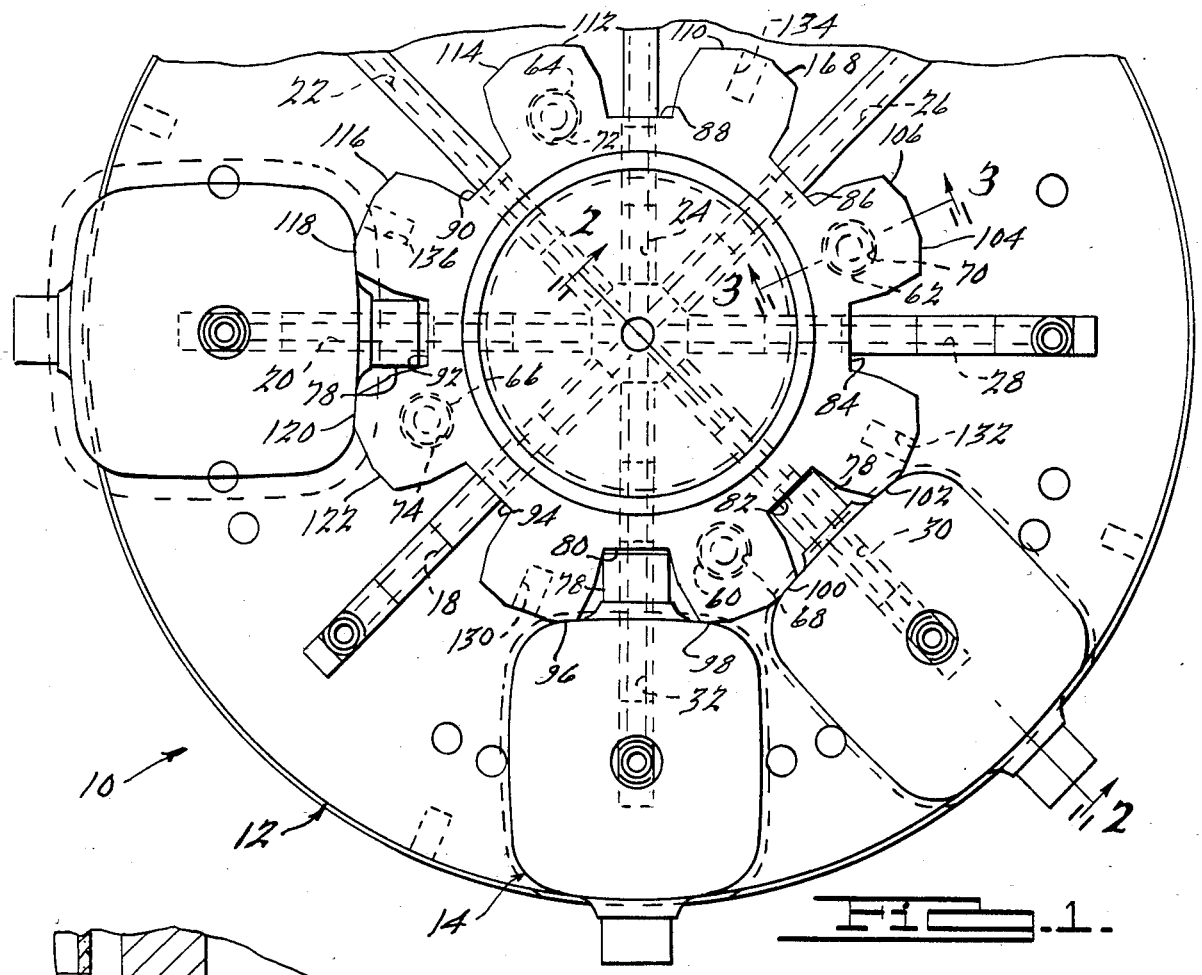
FIG. 1 is a top view of a sprue plate having a guide ring in accordance with the instant invention and having a plurality of ingot moulds mounted thereon.

A bottom pour ingot mould system 10, in accordance with an exemplary constructed embodiment of the instant invention, comprises a sprue plate 12 for the acceptance of a plurality of ingot moulds 14. While the sprue plate 12 illustrated in FIG. 1 of the drawing has provision for the acceptance of eight ingot moulds 14, it should be understood that any desired number can be accommodated. Each of the moulds 14 is fed from a common center runner 16, as will be described.

Figure 2:
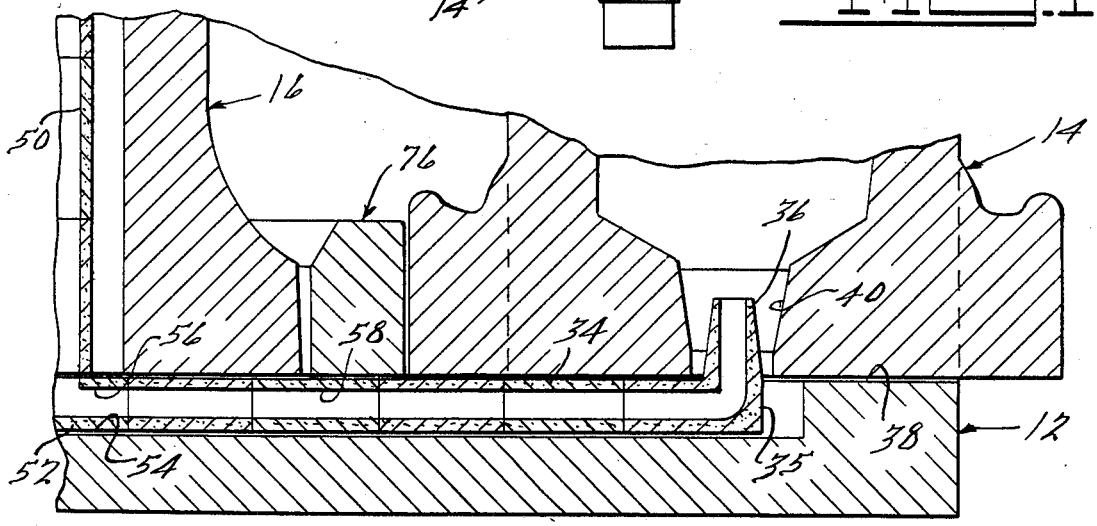
FIG. 2 is a fragmentary sectional view, taken along the line 2—2 of FIG. 1.

As illustrated in FIG. 1, the sprue plate 12 is provided with eight radially extending horizontal runners 18, 20, 22, 24, 26, 28, 30, and 32 each of which is adapted to feed an ingot mould 14. The sprue runners 18–32 are lined with hollow runner bricks 34, which terminate in an upstanding nozzle brick 35, one of which is shown in FIG. 2 of the drawing. It is to be noted that a nozzle portion 36 of the nozzle brick 35 extends above an upper surface 38 of the sprue plate 12 so as to telescope into a central passage 40 in the mould 14.

The center runner 16 of the sprue plate 12 is provided with a plurality of stacked runner bricks 50 for the acceptance of molten steel. The runner bricks 50 communicate with a spider brick 52 at the lower end thereof which is mounted in a central cavity 54 in the sprue plate 12. The spider brick 52 has horizontal passageways 56 therein which communicate with central passages 58 in the runner bricks 34 and nozzle brick 35.

Figure 3:
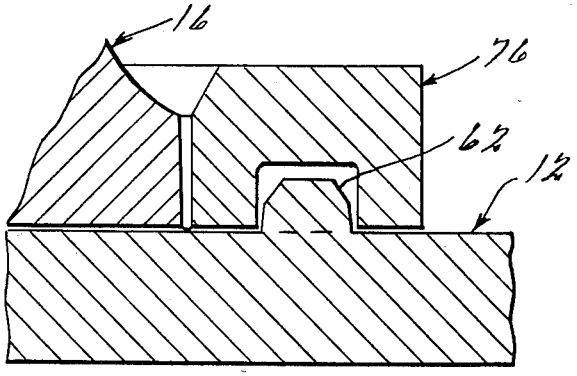
FIG. 3 is a fragmentary sectional view taken along the line 3—3 of FIG. 1.

In accordance with the present invention, the sprue plate 12 is provided with a plurality of upstanding guide ring locator pins 60, 62, 64, and 66, that, in a constructed embodiment of the invention, are integral with the plate portion of the sprue plate 12. As seen in FIGS. 1 and 3, the guide pins 60–66 are accepted in complementary sockets 68, 70, 72, and 74, respectively in a guide ring 76 to positively position the guide ring 76 relative to the sprue plate 12.

Noting the relatively small clearance between the nozzle 36 on the nozzle brick 35 and the central aperture 40 in the mould 14, precise positioning of the mould 14 relative to the sprue plate 12 is imperative. Moreover, since the nozzle 36 extends upwardly above the mould mounting surface 38 of the sprue plate 12, provision must be made for controlled downward movement of the mould 14 relative to the sprue plate 12 after the mould 14 and sprue plate 12 are vertically aligned relative to one another. This is accomplished by extending the height of the guide ring 76 upwardly a distance substantially greater than the height of the nozzle 36 above the surface 38. Thus, each mould 14 can be swung into engagement with the guide ring 76 and, while bearing thereagainst, be lowered over the nozzle 36 into engagement with the sprue plate 12.

In accordance with one feature of the instant invention, positive alignment of the mould 14 with the nozzle 36 is insured by engagement of alignment flanges 78 on each of the moulds 14 in complementary recesses 80, 82, 84, 86, 88, 90, 92 and 94 in the periphery of the guide ring 12. Angularly related bearing surfaces 96–98, 100–102, 104–106, 108–110, 112–114, 116–118, 120–122, and 124–126 are disposed on opposite sides of the recesses 80–94, respectively to aid in positioning of moulds 14. A plurality of pickup holes 130, 132, 134, and 136 are provided in the guide ring 76 to facilitate easy change of the guide ring 76 to accommodate moulds 14 of different configuration.

From the foregoing description it should be apparent that the guide ring 76 provides for positive alignment of the moulds 14 with the nozzles 36 of the sprue plate 12 yet is easily changed to accept different moulds. Alignment of each mould 14 with the guide ring 76 is accomplished by triangulation, noting that the recesses 80–94 in the guide ring 76 function in conjunction with the spaced bearing surfaces 96–118 to positively locate the moulds 14.

While the preferred embodiment of the invention has been disclosed, it should be appreciated that the invention is susceptible of modification without departing from the scope of the following claims.

We claim:

1. In a bottom pour ingot mould system comprising a sprue plate, a vertically extending center runner supported by said sprue plate, and a plurality of horizontal runners in said sprue plate each having an inlet for the acceptance of molten steel from said center runner and an outlet communicating with the bottom inlet of a steel ingot mould, an improved system for positioning said ingot moulds on said sprue plate comprising:

a one-piece annular guide ring telescoped over said center runner, a plurality of upstanding pins on said sprue plate, a plurality of sockets on the bottom of said guide ring for the acceptance of said pins for locating said guide ring, a plurality of circumferentially spaced generally rectangular recesses in the radially outer periphery of said guide ring for the acceptance of complementary rectangular flanges on the ingot moulds, respectively, said recesses and flanges cooperating to preclude rotation of said moulds about a vertical axis relative to said sprue plate, wherein, the width of each of said recesses, measured in the circumferential direction, increases with increasing radial distance from the center of the guide ring, a pair of angularly related circumferentially spaced positioning pads on said guide ring on opposite sides of each of said recess for engagement of the body of said moulds, respectively, whereby each of said moulds is positioned radially and circumferentially relative to said center runner and to the outlets in the runners of said sprue plate, the outlets in said horizontal runners comprising upstanding nozzles and said moulds being telescoped thereover, said guide ring having a vertical dimension greater than that of said nozzles to accommodate engagement of said mould with said ring upon horizontal movement of said mould above said nozzles to engage said flange within said recess and postion said pads against the mold body and subsequent downward movement of said moulds over said nozzles while engaged with said ring.

* * * * *